United States Patent [19]

Lange, Sr.

[11] Patent Number: 4,978,062

[45] Date of Patent: Dec. 18, 1990

[54] THERMOSTATIC EXPANSION VALVE WITH BI-DIRECTIONAL FLOW

[75] Inventor: Harold T. Lange, Sr., Frontenac, Mo.

[73] Assignee: Sporlan Valve Company, St. Louis, Mo.

[21] Appl. No.: 486,804

[22] Filed: Feb. 28, 1990

[51] Int. Cl.[5] ..... F25B 41/04

[52] U.S. Cl. ..... 236/92 B; 62/225; 251/326

[58] Field of Search ..... 62/324.1, 225; 236/92 B; 251/326, 327

[56] References Cited

U.S. PATENT DOCUMENTS

| | | | |
|---|---|---|---|
| 2,668,396 | 2/1954 | Kern | 251/327 X |
| 3,397,552 | 8/1968 | Harnish | 62/324.1 X |
| 3,871,615 | 3/1975 | Donner | 251/327 X |
| 4,389,037 | 6/1983 | Anders | 251/326 X |
| 4,467,621 | 8/1984 | O'Brien | 62/324.1 |

*Primary Examiner*—William E. Tapolcai

*Attorney, Agent, or Firm*—Cohn, Powell & Hind

[57] ABSTRACT

This thermostatic expansion valve (2) for heating-cooling refrigeration systems includes a body (4,8) having a transverse linear flow channel (10) therethrough. A tapered control valve element (12) divides the flow into identical inflow-outflow chambers (14,16) having equally sized inflow-outflow ports (22,24). The control valve element (12), when seated, prevents flow between the chambers (14,16), and is urged into a normally closed position by a biasing spring (26). A motor assembly (6) responsive to evaporator outlet pressure or compressor suction pressure, and temperature also controls movement of the valve element (12).

10 Claims, 2 Drawing Sheets

FIG. 2.
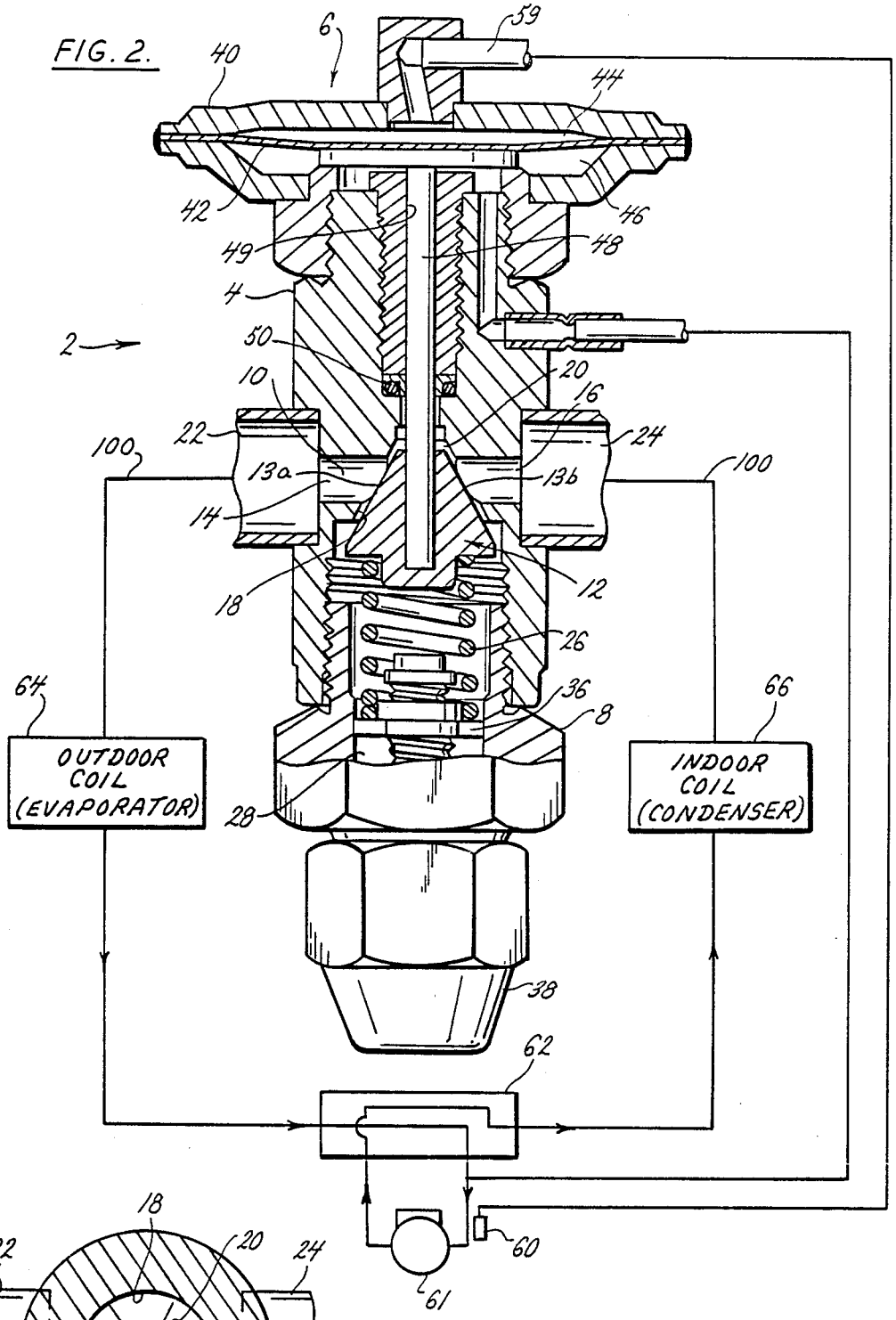
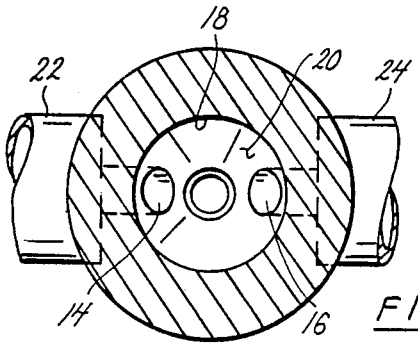
FIG. 3.

THERMOSTATIC EXPANSION VALVE WITH BI-DIRECTIONAL FLOW

BACKGROUND OF THE INVENTION

This invention, in general, relates to refrigeration and heating systems and in particular to an improved thermostatic expansion valve for use in refrigeration systems.

In a compression refrigerating system the refrigerant, in a gaseous state, is compressed and then passed into a condenser where it is cooled, condensed, and accumulated as a liquid. This liquid refrigerant, now at a higher pressure, flows into the inlet port of an expansion valve which has an outlet port conducting fluid to an evaporator. The expansion valve is generally a spring-loaded pressure reducing valve which allows the refrigerant to pass therethrough at a rate predetermined to maintain a given evaporator pressure. This reduction in pressure causes the refrigerant to evaporate in an evaporating coil. The resulting heat of vaporization is transfered to air, water, or any other fluid flowing over the evaporator coil.

Expansion valves, thus, are used in refrigeration and air conditioning systems as control devices which restrict the flow of liquid refrigerant as it passes from the condensor to the evaporator. Essentially, expansion valves control the flow of liquid refrigerant so that it arrives at the evaporator at a uniform rate consistent with the heat transfer capability of the evaporator coil. Such expansion valves fall generally into two categories, that is, fixed orifice devices, and variable orifice devices. In addition, variable orifice devices are usually classified as either automatic valves, or thermostatic valves such as the valve herein.

Thermostatic valves are the subject of such commonly owned U.S. Pat. Nos. 2,786,336 and 3,742,722, and 3,738,573. Essentially, as disclosed in such patents, expansion valves are spring loaded in one direction. This limits their use in bi-directional or reverse flow valves. However, in some refrigeration and air conditioning systems., such as heat pumps, it is necessary to provide for reverse refrigerant flow. If any of the known expansion valves, such as those referred to hereinbefore are used in such systems it is necessary to modify the system to permit their use. Even then, in the reverse direction additional superheat must be generated to overcome the spring force and the reverse closing force caused by the pressure difference. In addition, modified systems are not only cumbersome, but usually more expensive.

In commonly owned U.S. Pat. No. 4,852,364 the system modification problem was overcome by the provision of an expansion valve incorporating a built-in check valve. This valve overcomes the problems of the prior art, but it is still subject to two disadvantages. It includes additional working parts, and two complete expansion valves are required for use in a heat pump system. If a conventional expansion valve is used as a bi-directional valve, and in its normal operating direction of flow it controls flow at a superheat substantially different than it does in the reverse direction.

By the practice of this invention both of these disadvantages are overcome in a manner not disclosed in the known prior art.

SUMMARY OF THE INVENTION

A thermostatic expansion valve for heating-cooling refrigeration systems is provided herein permitting bi-directional flow without a check valve.

The expansion valve herein has a cylindrical valve body with a substantially transverse linear flow channel therethrough. A control valve element is disposed in the flow channel to divide the channel into identical inflow-outflow chambers, one on each side of the control valve, hence requiring no change in superheat when flow is reversed. A control valve seat is adapted, when the control valve element is seated, to prohibit flow from one chamber to the other in either direction. Inflow-outflow ports are disposed on each flow chamber end away from the control valve. The ports are equally sized, and symmetrically formed, so that inlet pressures are the same regardless of direction of flow. Spring biasing means urge the control valve into a normally closed position in the control valve seat. Facing each flow chamber are similar control valve element surfaces. They are the same in each flow chamber, thereby being adapted to urge the valve control element to an open position against the biasing spring by a higher pressure in either chamber on the either side of the control valve depending upon the direction of flow.

It is an aspect of this invention to provide a motor assembly, responsive to temperature and pressure at the evaporator outlet, of suction pressure at the compressor which is connected to the control valve element to control movement thereof when refrigerant flow is normal.

It is another aspect of this invention to provide an expansion valve which is relatively inexpensive, simple and effective in operation.

BRIEF DESCRIPTION OF THE DRAWINGS

FIG. 2 is a similar view to FIG. 1 with the system in a heating mode with counter clockwise fluid flow, and FIG. 3 is a cross-sectional view taken on line 3.3 of FIG. 1, with the valve element omitted.

DESCRIPTION OF THE PREFERRED EMBODIMENT

Figure 1:
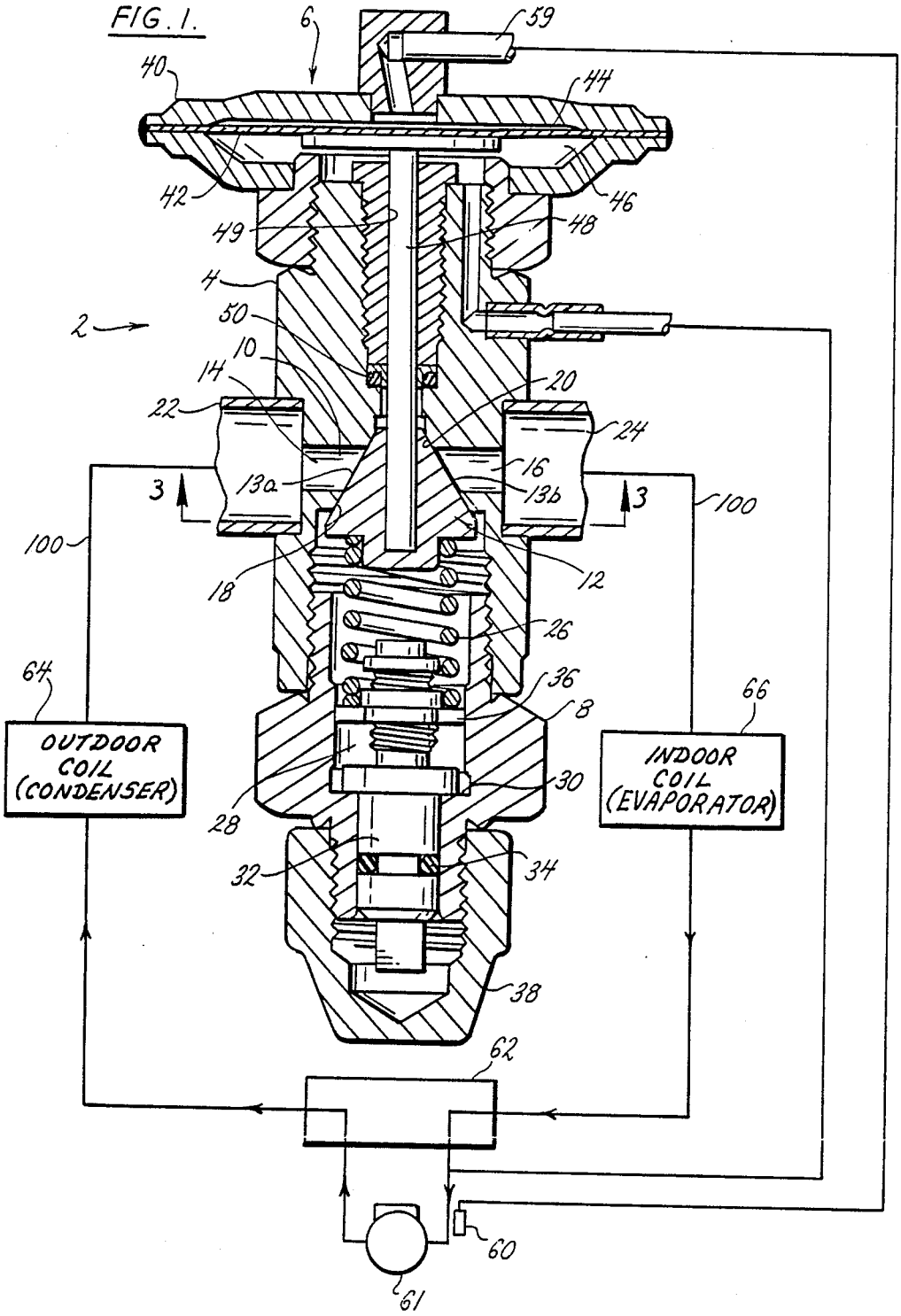
FIG. 1 is a longitudinal cross-sectional view of the thermostatic expansion valve with the system in an air-conditioning mode with clockwise fluid flow.

Referring now by reference numerals to the drawings, FIGS. 1 and 2, a cross-sectional view of an expansion valve 2 is shown having an upper valve body 4 surmounted by a motor assembly 6, to be described later. A threaded lower valve body 8 is removably attached to upper body 4 so that the connected valve body is in the form of a casing or barrel. Upper valve body 4 is fabricated with a transverse channel 10 passing therethrough. It is to be noted that the channel forms a linear flow passage. Accordingly when a control valve element 12 is positioned in the center of the passageway, as can be seen in FIG. 1, it divides the channel into two identical transversely aligned flow chambers 14 and 16. In the embodiment shown the tapered control valve element 12 is symmetrical and, in the preferred embodiment, is conically shaped and received in opening 18 with its conical face seating in the conical valve seat 20. When so seated flow in either direction is prohibited. As shown, the included angle of the valve element 12 is about sixty degrees (60°). However, it can range from about thirty–ninety degrees (30°–90°).

Cooperating to control the flow of refrigerant through flow channel 10 are ports 22 and 24. These ports also provide a means for connecting the lines or tubing 100, shown in FIGS. 1 and 2, forming the refrigeration system.

As indicated, lower valve body 8 and upper valve body 4 are so threaded that the two components can be connected together. This connection allows for the insertion of a bias spring 26. Lower valve body 8 is provided with passage 28 having a shoulder 30 accommodating rod 32 and seal 34, permitting spring tensioning, to urge control valve element 12 into a normally closed position. A threadedly adjustable seating washer 36 provides for adjustment of the spring pressure. A threaded closure cap 38 is attached to the lower end, also threaded, of lower valve body 8 to enclose the end of rod 32.

It will be noted that in FIG. 1 the valve is closed, and it is open in FIG. 2.

Prior to discussing the operation of the specific system, attention will be accorded diaphragm mechanism 6 which constitutes a motor assembly.

In the normal prior art utilization of an expansion valve between a condenser and an exaporator of a refrigeration system, an increase in head pressure at or above a predetermined suction pressure limit affects the expansion valve in a number of ways. It results in an increased pressure drop across the inlet valve port, requiring a smaller valve opening to maintain the same rate of flow, and it also causes unbalanced inlet valve port pressure. Reducing the valve opening produces a decrease in volume, and a corresponding increase in vapor pressure in the thermostatic element. The increase in the pressure imbalance of the valve port acts against the superheat spring, diminishing its effectiveness in maintaining the initial vapor pressure. The effect of both reduced valve opening and the increased pressure imbalance is to establish a new balance point at a higher suction pressure. A diaphragm mechanism in an expansion valve affords a means which compensates for any increased pressure differential across the valve port.

In the embodiment shown, diaphragm mechanism 6 includes a casing structure or housing 40 attached to the top portion of upper valve body 4. Within housing 40 is a diaphragm 42 in the form of a flexible movable disc which divides the chamber within the casing into separate, compartments 44 and 46, constituting first and second compartments respectively, one of which, compartment 46, is adjacent to, but separate from, the flow channel defined by chambers 14 and 16. In contact with diaphragm 42 is a follower stem 48, which through a passage 49 and a seal 50, is in contact with valve element 12. The seal 50, which includes a teflon cup and O-ring, prevents flow of refrigerant from the valve body 4 into the diaphragm housing lower chamber 46. The force generated, the cross-sectional area of the stem multiplied by the pressure difference across the seal, is always in the direction of closing the valve regardless of the direction of flow. Upper compartment 44 is connected, through capillary tubing 59, to a conventional bulb 60 located in thermal responsive relation to the outlet of an evaporator to compensate for any increased pressure differential across the inlet valve port, or for any increased pressure imbalance in that inlet port.

Recognizing that the diaphragm mechanism 6 will compensate for pressure differentials, operation of the apparatus utilizing the valve of the invention will now be described.

In FIGS. 1 and 2 a heat pump system including thermostatic expansion valve 2 is shown. This system includes a compressor 61 which selectively supplies refrigerant to an outdoor coil 64, or an indoor coil 66, depending upon whether the system is in an air conditioning cooling mode shown in FIG. 1, or a heating mode shown in FIG. 2.

In the cooling mode shown in FIG. 1 refrigerant is passed from compressor 61 through a four-way valve 62 to outdoor coil 64, which acts as a condenser. It is assumed that refrigerant liquid flowing into the inlet port 22 of expansion valve 2, now under pressure, acts initially on control valve surface **13*a* on that side moving the valve element 12 away from the valve opening 18 and valve seat 20 and of the control valve, opening the valve to permit flow around the conical surface of element 12. The refrigerant emerges from the outlet port 24 of expansion valve 2 at a low pressure and flows into indoor coil 66 which acts as an evaporator. From indoor coil 66 the refrigerant at a low pressure is returned to the four-way valve 62**.

In the heating mode shown in FIG. 2 refrigerant vapor at high pressure is passed from compressor 61 to indoor coil 66 which now acts as a condensor. At a high pressure, it is likewise assumed that refrigerant liquid acts initially against surface **13*b* of control valve element 12 in expansion valve 2, opening the valve so that the fluid can flow around said valve element and into outdoor coil 64. From outdoor coil the refrigerant is again returned to four-way valve 62**.

Since by this invention expansion valve inflow-outflow chambers 14 and 16 are identical, flow can be reversed without a change in superheat. In addition, since both inflow-outflow ports 22 and 24 of expansion valve 2 are symmetrical, inlet pressures are the same regardless of direction of flow. Contrary to prior art expansion valves additional superheat need not be generated, and an additional check valve is not required. The force generated by the pressure difference, in either direction will always compress biasing spring 26. Also flashing occurs upstream of the input port.

Having been given the teachings of this invention, ramifications and variations will occur to those skilled in the art. Thus, whereas a conical valve 12 has been discussed the cone can be truncated by a plane parallel to the cone base. In addition the valve need not be conical, but it can be any polyhedron, so long as the seat is adapted thereto. It will also be appreciated that the valve body, spring, and the like can be fabricated from a variety of metals. In addition the diaphragm mechanism can be modified as desired by those skilled in the art and, for example, a bellows mechanism can be used as the motor in lieu of a diaphragm. Such modifications are deemed to be within the scope of this invention.

I claim as my invention:

1. A thermostatic expansion valve for heating-cooling refrigeration systems of the type having an evaporator and a condenser, the expansion valve, without a check valve, providing for bi-directional flow, comprising:

(a) upper and lower valve bodies, the upper valve body having a substantially transverse linear flow channel therethrough, (b) a control valve element disposed in said flow channel dividing the channel into identical inflow-outflow chambers, one on each side of the control valve, thereby requiring no change in superheat when flow is reversed, (c) a control valve seat adapted, when the control valve element is seated, to prohibit flow from one chamber to the other in either direction, (d) inflow-outflow port disposed on each flow chamber end away from the control valve, the ports being substantially equally sized and symmetrically formed so that inlet pressures are the same regardless of direction of flow, (e) spring biasing means within the lower valve body urging the control valve element into a closed position in the valve seat, and (f) said control valve element having similar control valve surfaces facing each flow chamber, adapted to urge the control valve to an open position against the biasing spring by a higher pressure in either chamber on either side of the control valve depending upon the direction of flow.

2. The expansion valve of claim 1 wherein:

(g) the surfaces of the control valve element which face each flow chamber are inclined away from the valve seat so that an increase in pressure against the inclined surface in an inflow chamber urges the valve to an open position against the biasing spring.

3. The expansion valve of claim 2, wherein:

(h) the control valve element is in the form of a polyhedron with its base away from the valve seat.

4. The expansion valve of claim 2, wherein:

(h) the control valve element is in the form of a cone with its base away from the valve seat.

5. The expansion valve of claim 2 wherein:

(h) a motor assembly is provided for controlling movement of the control valve element when refrigerant flow is normal.

6. The expansion valve of claim 5 wherein:

(i) the motor assembly includes a diaphragm housing mounted on top of the upper valve body, defining a diaphragm chamber having a diaphragm therein separating said chamber into first and second compartments, means subjecting said diaphragm to a control pressure, and connecting means operatively connecting said diaphragm and said control valve element to control movement of said control valve element when refrigerant flow is normal.

7. The expansion valve of claim 6 wherein:

(j) the upper valve body includes an elongated passage extending between the diaphragm chamber and the flow chambers of the valve, and (k) the means for controlling movement of the control valve include a stem received within the passage abutting both the diaphragm and the control valve element.

8. The expansion valve of claim 6 wherein:

(j) the means subjecting the diaphragm to a control pressure include a means for subjecting said first diaphragm compartment to a vapor presssure responsive to temperature at the evaporator outlet when refrigerant flow is normal.

9. The expansion valve of claim 6 wherein:

(j) the means subjecting the diaphragm to a control pressure include means for subjecting the second diaphragm compartment to evaporator pressure when refrigerant flow is normal.

10. The expansion valve of claim 6 wherein:

(j) the means subjecting the diaphragm to a control pressure include a thermostatic bulb located at the evaporator outlet and having a fluid charge communicating with the first compartment, and a passage in the valve body operatively communicating between the diaphragm compartment and the evaporator when refrigerant flow is normal.

* * * * *